United States Patent [19]

Abishev et al.

[11] 4,368,176

[45] Jan. 11, 1983

[54] DESULFURIZING ROAST OF PYRITE BEARING POLYMETALLIC RAW MATERIAL

[76] Inventors: Dzhantore N. Abishev, ulitsa Michurina, 21/3, kv. 44; Evnei A. Buketov, ulitsa Lenina, 56, kv. 3, both of Karaganda; Aigul T. Shindauletova, ulitsa Kirova, 135, kv. 5, Alma-Ata; Nazymkul Baltynova, prospekt Sovetsky, 52-a, kv. 40, Karaganda; Ida N. Babskaya, bulvar Mira, 47, kv. 57, Karaganda; Abubakir K. Kobzhasov, prospekt Sovetsky, 75, kv. 12, Karaganda; Vitaly P. Malyshev, ulitsa Botanicheskaya, 14, kv. 52, Karaganda; Ivan K. Bauer, ulitsa Botanicheskaya, 14, kv. 30, Karaganda; Murat M. Mukhamedinov, rudoupravlenie "Maikainzoloto", Pavlodarskaya oblast, poselok Maikain; Temirkhan A. Kusainov, ulitsa Dzerzhinskogo, 63, Karaganda; Kasken N. Orazalina, ulitsa Dzhambuła, 129, kv. 12, Karaganda; Eslambek A. Buketov, Karagailinsky GOK, poselok Karagaily Karagandinskoi oblasti, all of U.S.S.R.

[21] Appl. No.: 224,521

[22] PCT Filed: Jul. 31, 1979

[86] PCT No.: PCT/SU79/00063

§ 371 Date: Mar. 31, 1981

§ 102(e) Date: Nov. 24, 1980

[87] PCT Pub. No.: WO81/00418

PCT Pub. Date: Feb. 19, 1981

[51] Int. Cl.[3] ..... C22B 1/02

[52] U.S. Cl. ..... 423/25; 423/47; 423/152; 423/154; 75/6; 75/7; 23/294 S; 75/6;7

[58] Field of Search ..... 423/25, 47, 151, 152, 423/153, 154; 23/294 S; 75/6, 7

[56] References Cited

U.S. PATENT DOCUMENTS

| | | | |
|---|---|---|---|
| 564,423 | 7/1896 | Edison | 423/25 |
| 1,103,081 | 7/1914 | Rigg | 423/154 |
| 1,535,468 | 4/1925 | Hedges | 23/294 S |
| 2,103,131 | 12/1937 | Wolf | 423/154 |
| 3,042,501 | 7/1962 | Noblitt | 23/294 S |

FOREIGN PATENT DOCUMENTS

| | | |
|---|---|---|
| 150629 | 8/1961 | U.S.S.R. . |
| 128032 | 9/1978 | U.S.S.R. . |

OTHER PUBLICATIONS

Greiver, Ed. *Fundamentals of Metallurgy, vol. 1, part II, Moscow, (1961) pp. 68, 69.*

*Primary Examiner*—Brian E. Hearn
*Attorney, Agent, or Firm*—Lilling & Greenspan

[57] ABSTRACT

A method comprises heating the material to be treated without access of air at a temperature of 700° to 800° C. for a period of 1-2 hours, and then subjecting this material to subsequent magnetic separation.

It is advisable that the furnace walls surrounding the material under treatment be heated to a temperature which is 100° C. to 200° C. higher than the boiling temperature of the volatile components of the material. Upon completion of the heating operation, the material being treated is cooled at a rate of 2 to 4 deg. per minute, whereafter iron sulphides are removed therefrom by means of magnetic separation, the intensity of magnetic field ranging from 1000 to 2000 oersted, and then copper sulphides are separated, with the field intensity ranging from 4500 to 6000 oersted.

5 Claims, No Drawings

DESULFURIZING ROAST OF PYRITE BEARING POLYMETALLIC RAW MATERIAL

BACKGROUND ART

The present invention relates to metallurgy, and more particularly, to a method of treating pyrite bearing polymetallic material to obtain elemental sulphur, pyrrhotine concentrate to be subjected to further treatment with the purpose of removing the residual sulphur therefrom, and producing iron-ore pellets as well as the product enriched with nonferrous, rare and noble metals separated to form selective conditioned concentrates by any conventional technique.

This invention can find advantageous application in the treatment of pyrite bearing polymetallic material which includes non-ferrous, rare and noble metals.

There is known in the art a method of treating pyrite concentrate, which comprises heating (roasting) this material in the atmosphere of inert gas without air access, and then subjecting it to flash roasting at a temperature within the range of 1800° C. to 2000° C. Here, the pyrite concentrate, containing 46% by weight of iron and 52.8% by weight of sulphur, is subjected to thermal decomposition with the resultant formation of matte and separation of elemental sulphur. The matte is then granulated and roasted in a furance in a fluidized bed, this being accompanied by the liberation of sulphuric gases to be utilized for the production of sulphur acid. The resultant iron concentrate may contain up to 67% by weight of iron.

However, the aforedescribed method fails to provide for the recovery of nonferrous, rare and noble metals. It is only suitable for the treatment of pyrite concentrate high in sulphur.

There is a known method for treating pyrite concentrates less rich in sulphur and iron, containing 38.5% by weight of iron, 39.1% by weight of sulphur and 20% by weight of gangue. This method comprises an oxidizing roasting of the initial material, carried out in a furance in a fluidized bed at a temperature of 965° C. The resultant roast is then subjected to a reducing magnetizing roasting at a temperature of 550° to 650° C., followed by magnetic separation thereof. The oxidized roast undergoes magnetic separation at a magnetic field intensity of 100 to 600 oersted. The resultant magnetic product undergoes pelletizing and firing, whereafter it contains up to 66% by weight of iron, thus being rendered suitable for blast-furnace smelting.

This method also fails to provide for the recovery of nonferrous, rare and noble metals.

Recovery of nonferrous and noble metals from pyrite concentrates is effected by means of oxidizing roasting of initial material in a furnaces in a fluidized bed at a temperature of 900° C. The resultant gases are used for the production of sulphuric acid, and the oxidized roast is granulated in 40% solution of calcium chloride to be thereafter subjected to secondary roasting conducted at a temperature of 1250° C. in cylindrical rotary kilns. The resultant iron-containing product is employed in blast furnaces. The gases evolved in the process of secondary roasting contain chlorides of nonferrous and noble metals.

The above-described method, however, includes two-stage roasting of high-grade pyrite concentrates, effected at high temperatures, which substantially increases the operating costs.

Another known method used for the recovery of nonferrous and noble metals from polymetallic material comprises subjecting this material to oxidizing roasting, which is effected in a furnace in fluidized bed at a temperature of 704° to 816° C. until pyrrhotine is obtained. The pyrrhotine is then subjected to aqueous lixiviation in an autoclave, with oxygen under pressure being fed therein. The nonferrous metals are passing to a solution from which they are further precipitated by means of hydrogen sulphide.

However, the roasting procedure combined with autoclave lixiviation and subsequent hydrometallurgical recovery of nonferrous metals renders the above method cumbersome and complicated.

Various techniques employed today in the treatment of rebellious polymetallic ores, notwithstanding numerous modifications and improvements, fail to satisfy growing demands of nonferrous metallurgy in high-grade selective concentrates. Thus, the increase of total volume of pyritous polymetallic concentrates, intermediary products and tails makes it absolutely necessary and essential to develop effective and comprehensive methods of treating these types for materials to yield valuable products, such as elemental sulphur, iron-ore pellets and concentrates of nonferrous metals.

DISCLOSURE OF THE INVENTION

It is therefore the primary object of the invention to provide a method of treating pyritous polymetallic raw material, which will promote more effective recovery of iron, sulphur, as well as nonferrous, noble and rare metals, as compared to known methods used for similar purposes, and to simplify the flowsheet of treating pyritous polymetallic material, minimize the losses of valuable minerals and to reduce the operating expenses involved in the treatment of pyrite bearing polymetallic material.

According to the invention, there is provided a method of treating pyritous polymetallic material, comprising heating this material without air access and its subsequent separation into products by means of magnetic separation, wherein the heating is effected prior to magnetic separation at a temperature of 700° to 800° C. for a period of 1-2 hours.

With the initial material being heated to a temperature on the order of 700°-800° C. for a period of 1-2 hours, the valuable minerals and gangue contained therein do not undergo any chemical conversion, and pyrite dissociates in accordance with the following reaction:

$$FeS_2 \rightarrow Fe_nS_{n+1} + S^{\circ},$$

where n = from 5 to 10.

This makes it possible to obtain about 43-45% by weight of pyrite sulphur in an elementary state and to have diamagnetic pyrite converted into ferromagnetic hexagonal pyrrhotite. The process of thermal treatment (roasting) is accompanied by sulphidizing of the oxidized minerals of nonferrous metals, decrepitation of the grains of minerals and self-grinding of the material, which results in a higher yield of valuable metals, improved separation of minerals during magnetic separation and lower energy requirements for subsequent crushing operations.

In heating the initial material to a temperature below 700° C., there is observed incomplete transition of pyrite into ferromagnetic pyrrhotine, whereas at temperatures above 800° C. and with durations of heating periods exceeding 2 hours, there takes place transition of ferromagnetic pyrrhotine into nonmagnetic pyrrhotine with a lower content of sulphur, down to troilite. This sharply reduces the recovery of iron found in magnetic pyrrhotine concentrate.

It is advisable that the walls surrounding the material under treatment be heated to a temperature which is 100° to 200° C. higher than the boiling temperature of the material volatile components.

With this condition observed, a gap is formed between the furnace walls and the material under treatment, which is filled with gaseous and vaporous products formed during roasting the operation. The presence of gaseous and vaporous products makes for sliding movement of the treated material during its descent, reduces the extent of its fusion and eliminates its sticking to the furnace walls, thus ensuring successful treatment of material of practically any degree of moisture and particle size.

If the temperature of the furnace walls surrounding the material under treatment is by 100° C. lower than the boiling temperature of the material's volatile components, the desirable results cannot be attained. An increase in the temperature of the furnace walls by more than 200° C. is economically unprofitable.

Where copper-containing material undergoes treatment, its cooling is preferably effected at a rate of 2 to 4 deg. per min, and magnetic separation is preferably carried out in two stages, initially separating iron sulphides at a magnetic field intensity ranging from 1000 to 2000 oersteds, followed by separation of copper sulphides to be effected at the field intensity ranging from 4500 to 6000 oersted.

Effecting the cooling of the material being treated at a rate of 2 to 4 deg. per min. makes possible the transition of the copper minerals contained in the initial material, in particular, cubic diamagnetic chalcopyrite into tetragonal modification with somewhat lower content of sulphur possessing magnetic properties. The cooling of the roasted material at a rate lower than 2 deg. per min prolongs the duration and increases the cost of treatment of pyritous material, whereas a higher rate of cooling, above 4 deg. per min, brings down the recovery of copper, to copper concentrate.

By carrying out magnetic separation in two stages and within the aforeindicated range of the magnetic field intensity, it becomes possible to simplify the technological process of treating pyritous polymetallic material and reduce operating costs, as compared to known methods which comprise multiple roasting of initial material or its treatment in autoclaves. A decrease in the intensity of magnetic field, as compared to the recommended value in accordance with the invention, below 1000 oersteds in the first stage and below 4500 oersteds in the second stage, will respectively result in lower yields of pyrrhotine and copper concentrates. An increase in the intensity of magnetic field above 200 oersteds in the first stage and above 6000 oersteds in the second stage will impair the quality of pyrrhotine and copper concentrates.

BEST MODE OF CARRYING OUT THE INVENTION

The invention will be further explained by the following illustrative Examples.

EXAMPLE I

Ore refuse (tails) poor in pyrite, containing 28% by weight of iron, 33.5% by weight of sulphur, 0.85% by weight of lead, 0.94% by weight of zinc, 0.26% by weight of copper, 30% by weight of quartz, were subjected to heating without air access at a temperature of 750° C. for a period of 1 hour. The recovery of volatile matter was 15.6 wt.%. The heat-treated material was cooled at a rate of 2 deg. per min, and then was subjected to magnetic separation in an aqueous medium with a laboratory magnetic analyzer, at a magnetic field intensity of 1000 oersteds. The yield of the first magnetic fraction obtained, i.e. pyrrhotine concentrate, was 43.04 wt.%. The pyrrhotine concentrate contained 59.42 wt.% iron, 0.09 wt.% copper, 0.17 wt.% lead, 0.08 wt.% zinc and 5.0 wt.% quartz. The recovery from the initial material was 91.34% iron, 14.90% copper, 8.61% lead, 3.66% zinc and 7.17% quartz. the nonmagnetic fraction was subjected to secondary magnetic separation in aqueous media at a magnetic field intensity of 4500 oersteds. The recovery in the second magnetic fraction, i.e. magnetic concentrate, was 2.25% by weight of the initial material. The resultant copper concentrate contained 8.96 wt.% copper, 0.79 wt.% lead, 0.61 wt.% zinc, 13.2 wt.% iron and 12.12 wt.% quartz. Recovery from the initial material was 77.58% copper, 2.09% lead, 1.46% zinc, 1.26% iron and 1.02% quartz. The end nonmagnetic fraction contained 70.43 wt.% quartz, 5.3 wt.% iron, 0.05 wt.% copper, 1.94 wt.% lead, and 2.28 wt.% zinc. The recovery from the initial material into nonmagnetic fraction contained 91.80% quartz; 7.40% iron; 7.53% copper; 89.24% lead and 9.4.84% zinc.

EXAMPLE 2

Pyrite concentrate, containing 38 wt.% iron, 43.3 wt.% sulphur 0.06 wt.% lead, 0.32 wt.% zinc and 12.0 wt.% quartz, was heated without air access at a temperature of 800° C. for a period of 1 hour. The yield of volatile components was 18.76 wt.%. The heat-treated material was cooled and then separated in an aqueous medium at a magnetic field intensity of 1500 oersteds. The recovery of the magnetic fraction was 80 wt.%. The magnetic fraction contained 57.5 wt.% iron, 37.0 wt.% sulphur, 0.04 wt.% lead, 0.18 wt.% zinc, and 1.65 wt.% quartz. Recovery from the initial material was 98.34% iron, 55.17% sulphur, 46.80% lead; 37.12% zinc, and 8.91% quartz. The nonmagnetic fraction contained 7.0 wt.% iron, 5.0 wt.% sulphur, 2.0 wt.% lead, 1.25 wt.% zinc and 66.80 wt.% quartz. Recovery from the initial material was 1.97% iron; 53.30% lead; 63.43% zinc, 1.86% sulphur and 89.16% quartz.

EXAMPLE 3

A molybdenum industrial product having the following composition, in percent by weight: 13.50 molybdenum, 34.26 iron, 44.80 sulphur, 5.65 quartz, was subjected to heating without air access in a continuous shaft furance. The material under treatment descended by gravity. The furance walls were maintained at a temperature of 150° C. higher than the dissociation temperature of the pyrite contained in the molybdenum product in an amount of 65 percent by weight. It is possible either to raise or lower the temperature of the surface walls, either up to 200° C. or down to 100° C., respectively, depending on the content of volatile components in the initial material. The amount of pyrite sulphur driven off the initial material was 42.72 wt%. Subsequent magnetic separation effected at the intensity of magnetic field of 2000 oersteds results in a magnetic fraction containing 58.92 wt.% iron, 36.75 wt.% sulphur, 1.91 wt.% molybdenum, 0.73 wt.% quartz. The yield of iron recovered from the initial material into the magnetic fraction was 94.35%. The nonmagnetic fraction contained 45.34 wt.% molybdenum and 18.45 wt.% quartz. The former and the latter were recovered from the initial material in an amount of 95.68% and 94.70% respectively. Subsequent flotation of the nonmagnetic fraction resulted in a high-grade molybdenum concentrate containing 54.14 wt.% molybdenum and 3.12 wt.% quartz.

EXAMPLE 4

Ore, containing 38.6 wt.% iron, 5.64 wt.% copper, 0.35 wt.% lead, 3.51 wt.% zinc, 2 g/t gold, 100 g/t silver and 45.4 wt.% sulphur, was subjected to heating without air access at a temperature of 700° C. for a period of 2 hours, followed by subsequent cooling effected at a rate of 4 deg. per min. Copper was present in the ore in the form of diamagnetic tetragonal chalcopyrite. The heat-treated product, after iron sulphides has been removed therefrom by magnetic separation at the intensity of magnetic field of 1500 oersteds, was subjected to secondary separation with the magnetic field intensity being 6000 oersteds. The recovery of copper to copper concentrate was 87.0%. The nonmagnetic product contained lead, noble metals and zinc.

From the above it follows that the method of the invention can be successfully used in the treatment of various pyrite bearing polymetallic materials for the recovery of elemental sulphur, pyrrhotine concentrate, the latter being high-grade material used for the production of iron-ore pellets and sulphuric acid, selective copper concentrate and the product rich in nonferrous, rare and noble metals, which is further separated to form selective conditioned concentrates.

The method of the invention makes it possible to carry out comprehensive treatment of pyrite bearing polymetallic materials, minimizing the loss of valuable materials.

INDUSTRIAL APPLICABILITY

Laboratory investigations and industrial trials carried out to confirm the expected results of the invention have been successful. The commercial product under treatment was pyritous molybdenum product having the following chemical composition: 31.99 wt.% molybdenum; 18.18 wt.% iron, 42/25 wt.% sulphur; 4.42 wt.% quartz; and pyrite polymetallic ore containing 40.0 wt.% iron, 46.7% sulphur, 0.22 wt.% zinc, 0.92 wt.% copper and 4.03 wt.% quartz.

Nonmagnetic concentrate resulting from the initial material contained, in the first instance, 98% molybdenum and 96% quartz whereas in the second instance it contained 80% zinc, 85% lead and 90% quartz. The copper concentrate resultant from the initial material contained 88% copper. Elemental sulphur recovered from the initial material amounted up to 45%. The resultant magnetic product contained 90–98% iron. After oxidizing roasting, the resulting iron concentrate contained 62–67% iron and 0.5% sulphur.

What we claim is:

1. A method for treating a pyrite bearing polymetallic material comprising ferrous, non-ferrous, rare and noble metals, which comprises: heating said material in a walled vessel without air access at a temperature of about 700° to 800° C. for about 1 to 2 hours, wherein the walls of the vessel surrounding said polymetallic material are heated to a temperature of about 100° to 200° C. higher than the boiling temperature of the volatile components of the polymetallic material; and magnetically separating the products formed.

2. The method of claim 1 wherein the heated material is cooled at a rate of 2 to 4 degrees per minute, thereby effecting a transition of copper sulfides contained in the polymetallic material from cubic diamagnetic chalcopyrite into its tetragonal modification, followed by a two stage magnetic separation, wherein in the first stage iron sulfides are separated at a magnetic field intensity of about 1000 to 2000 oersteds, and in the second stage copper sulfides are separated at a magnetic field intensity of about 4500 to 6000 oersteds.

3. A method for treating a pyrite bearing polymetallic material comprising ferrous, non-ferrous, rare and noble metals, which comprises: heating said material in a walled vessel without air access at a temperature of about 700° to 800° C. for about 1 to 2 hours; cooling the heated material at a rate of 2 to 4 degrees per minute, thereby effecting a transition of copper sulfides contained in the polymetallic material from cubic diamagnetic chalcopyrite into its tetragonal modification, followed by a two stage magnetic separation, wherein in the first stage iron sulfides are separated at a magnetic field intensity of about 1000 to 2000 oersteds, and in the second stage copper sulfides are separated at a magnetic field intensity of about 4500 to 6000 oersteds.

4. The method of claim 3, wherein the walls of the vessel surrounding said polymetallic material are heated to a temperature of about 100° to 200° C. higher than the boiling temperature of the volatile components of the polymetallic material.

5. The method of any of claims 1 or 3, wherein at the heating temperature of 700° to 800° C., the pyrite dissociates in accordance with the equation:

$$FeS_2 \rightarrow Fe_nS_{n+1} + S^\circ$$

where n=5 to 10.

* * * * *